US006840331B2

(12) United States Patent
Sant'Angelo

(10) Patent No.: US 6,840,331 B2
(45) Date of Patent: Jan. 11, 2005

(54) PORTABLE BREATHABLE FIRE EXTINGUISHING LIQUEFIED GAS DELIVERY SYSTEM

(76) Inventor: Joseph G. Sant'Angelo, 568 Parkside Ct., Allentown, PA (US) 18104

( * ) Notice: Subject to any disclaimer, the term of this patent is extended or adjusted under 35 U.S.C. 154(b) by 0 days.

(21) Appl. No.: 10/335,526

(22) Filed: Jan. 3, 2003

(65) Prior Publication Data

US 2003/0141082 A1 Jul. 31, 2003

Related U.S. Application Data

(60) Provisional application No. 60/352,170, filed on Jan. 29, 2002.

(51) Int. Cl.[7] ..... A62C 13/62; A62C 13/66; A62C 27/00; A62C 35/00

(52) U.S. Cl. ..... 169/71; 169/24; 169/11

(58) Field of Search ..... 169/71, 24, 11, 169/44, 46, 53, 14

(56) References Cited

U.S. PATENT DOCUMENTS

| | | | | | |
|---|---|---|---|---|---|
| 2,450,537 | A | * | 10/1948 | Williamson | 169/11 |
| 3,438,445 | A | * | 4/1969 | Maccracken | 169/44 |
| 4,311,198 | A | * | 1/1982 | Vasquez | 169/11 |
| 4,807,706 | A | * | 2/1989 | Lambertsen et al. | 169/45 |
| 5,327,732 | A | * | 7/1994 | De Almeida | 62/50.2 |
| 5,507,350 | A | * | 4/1996 | Primlani | 169/47 |
| 6,446,731 | B1 | * | 9/2002 | Sorosky | 169/24 |
| 6,502,421 | B2 | * | 1/2003 | Kotliar | 62/640 |

* cited by examiner

*Primary Examiner*—Michael Mar
*Assistant Examiner*—Darren Gorman

(57) ABSTRACT

This invention provides a means for transporting and delivering highly effective, breathable fire fighting inert gases to a fire zone, whereby the normally inert gas is transported to the fire in liquid or compressed form.

20 Claims, 6 Drawing Sheets

PORTABLE BREATHABLE FIRE EXTINGUISHING LIQUEFIED GAS DELIVERY SYSTEM

This application claims the benefit of Provisional application No. 60/352,170, filed Jan. 29, 2002.

BACKGROUND OF INVENTION

The most common fire fighting vehicles in use today deliver water to extinguish fires. (Fire trucks, fire boats etc.) Some back-pack or fixed carbon dioxide or chemical systems are used for small fires. When using water for large fires, large quantities are needed. Although water is a useful fire fighting agent for Class 1 (paper and wood) fires, it is slow, and produces much damage to interior structures and equipment etc. In winter freezing of water on hoses and ladders causes problems. Also people must first be removed from burning structures before water can be safely used. Generally, one water hose team of 4 men can extinguish 1200 square feet. For Class 2 fires (oil, gasoline etc.), water is not very effective. Halogen based chemicals such as that available under the brand name Halon, are toxic and also damage equipment. Very large areas, such as entire floors as in the World Trade Center fire, cannot be extinguished using water. For tall buildings, skyscrapers etc the water system depends on internal piping systems which may not always be operational. This invention provides an external, large capacity independent non-toxic, non-damaging fast extinguishing system, which is superior to conventional systems currently used.

In this invention, liquid, cryogenic inert gases are transported to the fire which when converted to gaseous form expand over 700 times at 70° F., and another 4 times at the fire temperature of about 1500° F. A truck carrying 10,000 gallons of liquid will convert to 28 million gallons of gas, which can treat 1800 average size rooms.

Previous patents have disclosed the composition of gases used to extinguish fires, where the oxygen content is reduced (U.S. Pat. Nos. 3,893,514, 4,807,706), and or chemicals are added which impart to the atmosphere heat capacity sufficient to suppress the combustion in the enclosed area (U.S. Pat. Nos. 3,715,438, 3,840,667, 1,926,396). In U.S. Pat. No. 4,807,706, oxygen is reduced and carbon dioxide added into the fire zone, making the atmosphere in the fire zone breathable.

Generally these are fixed in place systems, with means to detect fires and introduce the appropriate gas or chemical, with the agents at room temperature.

This invention comprises liquefying appropriate gases and transporting them to the fire, where the gases are applied directly to the fire in either liquid or gaseous form. This provides an independent external, non-toxic system of fire extinguishing gases which reduce the oxygen content of the enclosed air in the fire zone and /or cools the fuel. The gases permeate into all space quickly, including closed desk drawers, to quickly put out fires.

BRIEF SUMMARY OF THE INVENTION

This invention provides a means for transporting and delivering highly effective fire fighting inert liquid gases to the fire. The inert material can be both breathable, (non-toxic), or toxic. The transport of liquid or gaseous inert gases can be by firetrucks, fireboats, or helicopters. The gas can be carried in liquid form, to maximize the volume of agent being transported to the fire. The inert gas can also be provided using nitrogen generating devices such as pressure swing or membranes systems. At the fire scene the liquids are converted to the gaseous form by a heat exchanger, or by the fire heat if the liquid is applied directly to the fire. The nitrogen and carbon dioxide are mixed in the appropriate ratios to form a breathable fire extinguishing gas mixture, which is then applied to the fire in liquid and or gaseous form. Appropriate conduit and lance systems are used to deliver the gas mix into fire.

DETAILED DESCRIPTION OF THE INVENTION

This invention relates to a transportable system for delivering a fire extinguishing gas to a fire zone. The system comprises a storage vessel for a normally gaseous inert gas and a delivery means for delivering the inert gas to the fire zone. By inert is meant a gas that does not react under ambient conditions or the high temperatures of the fire zone.

In one embodiment, the storage vessel for the inert material is a cryogenic vessel that stores the inert material in liquid form. Insulated vessels or tanks capable of storing normally gaseous materials in liquid form are well known in the art and available commercially. When the inert material is in liquid form, the system can also comprise a means for vaporizing the inert material prior to delivering or introducing the inert material to the fire zone or the inert material can be delivered directly to the fire zone and vaporized in situ in the fire zone.

In another embodiment of this invention, the inert material is stored in the storage vessel in gaseous form. In this embodiment there is no need to vaporize the inert material prior to introduction into the fire zone.

Preferably, the inert fire extinguishing gas employed in the system of this invention is a breathable mixture that contains carbon dioxide. In such embodiment, the system of this invention also contains a storage vessel for carbon dioxide and a means for mixing the inert gas and the carbon dioxide to form the breathable mixture. In the embodiment wherein the inert gas is stored in liquid form in a cryogenic vessel, the means for vaporizing the inert gas can be located upstream of the means for mixing the inert gas and the carbon dioxide.

As mentioned above, the inert gas can be stored in a gaseous form, in which case the storage vessel for the inert gas can be a pressure vessel of the type well known in the industry for the storage of compressed gasses.

When the system is operating to produce a mixture of inert gas and carbon dioxide, the vessel for storing the carbon dioxide can store the carbon dioxide in a form selected from the group consisting of solid, liquid, gaseous and supercritical forms.

When utilizing carbon dioxide it is within the scope of this invention that the inert material and carbon dioxide mixing zone is located at the end of the delivery means and in the area where the mixture is delivered to the fire zone.

In accordance with this invention the delivery means comprises a conduit which is capable of transporting a cryogenic fluid. Thus, the delivery means can be a rigid telescoping conduit. The delivery means can also be an extendable, flexible, coiled metal conduit.

In the case wherein the fire zone is an enclosed volume and the inert gas is nitrogen, the nitrogen and the carbon dioxide are metered so that the mixture introduced into the fire zone contains from about 88 to about 96% by volume of nitrogen and from about 4 to about 12% by volume carbon dioxide so as to provide a gaseous mixture in the fire zone containing less than about 15% by volume oxygen and from about 2 to about 5% by volume of carbon dioxide. It is preferred that the oxygen content of the gaseous mixture in the fire zone be maintained above about 8%, for example above about 10%. Preferably, the nitrogen content of the mixture introduced is at least about 90% by volume. It is also preferred that the nitrogen concentration is less than about 94% by volume. It is also preferred that the carbon dioxide concentration in the mixture introduced into the fire zone is at least about 6% by volume. It is also preferred that the carbon dioxide concentration be less than about 10% by volume. Replacing about one half of the room volume with the incoming gas mixture will reduce the oxygen content below 15% and quickly extinguish the fire in a matter of minutes. Under certain circumstances air can also be used with the incoming nitrogen and carbon dioxide to flush the fire zone.

The invention consists of three different modes for transporting, mixing, and delivering the inert gases into the fire zone. An all-liquid system, a liquid to gas system, an all gas system.

The all liquid system consist of the vehicle for carrying the cryogenic, inert liquefied gases in insulated vessels at temperatures below minus 320° F., in the range of (−320 to −452° F.). The vehicle can be a truck, boat or helicopter.

The liquefied gas is contained in insulated vessels generally used for holding low temperature cryogenic fluids, and mounted on the vehicle of choice. Attached to the holding vessels are metering pumps generally used for pumping cryogenic fluids. Downstream of the metering pumps is a mixing vessel or unit for mixing the liquid gas with carbon dioxide, which can be solid, liquid, gas or supercritical form. Downstream of the mixing device are pumps for the liquefied gas, to be used if additional pressures are needed for delivery to the fire. Downstream of the mixing system is means for delivering the material to the fire. Such means can be an insulated, telescoping metal conduit for transporting the liquid gases into the fire zone. This conduit can be separate or a part of the vehicle, and can be directed vertically and horizontally. Affixed to the exit end of conduit is a heavy-duty lance for penetrating windows or walls. If materials are in the gaseous form the means for delivering the material can be a flexible conduit. This integrated system delivers liquid gases directly into the fire zone, where the liquid expands into a gas due to the heat of the fire. The gas is 2800 times the volume of the starting liquid. A fire vehicle carrying 10,000 gallons of liquid gas can produce 28 million gallons of fire extinguishing gas in the fire zone. At 7.48 gallons per cubic foot it is equal to 3.7 million cubic feet of gas. A 10'×10'×10' room is equal to 1000 cubic feet; therefore the system can fill 3,700 rooms or 1850 rooms given 50% loss and the volume needed to reduce oxygen below 15%.

The liquid to gas system converts the liquid inert to the gaseous form in the transmission conduit using a heat exchanger commonly used for cryogenic fluids. This would deliver gases to the conduit, permitting firemen to reach higher levels due the lightweight of the gas system. In this system the liquid gas can pass through a heat exchanger forming the gaseous state, on to the mixing device. Carbon dioxide can be metered into the mixing device as a solid, liquid, gas or supercritical fluid. The mixture can then be fed to the conduit system. The conduit consists of either a rigid telescoping insulated conduit or a flexible coiled accordion metal conduit, with attached lance at the exit end.

The high-pressure gas system contains the gases in high-pressure tubes, 500 to 20,000 pounds per square inch pressure, mounted on the delivery vehicles. These gases are metered into the mixing vessels with carbon dioxide. The high-pressure gases are delivered as above to a flexible conduit and or a lance system for delivery into the fire. Pumps can also be used if higher pressure is needed.

The gases are pumped into the fire zone to reduce the oxygen content below 15% and maintain the carbon dioxide in the 1–3% range.

In the three systems described above the carbon dioxide can be delivered into the process stream conduits, upstream of the conduit and lance, where the inert can be either liquid or gas. The carbon dioxide can be in the solid, liquid, gaseous or supercritical state. The carbon dioxide can also be delivered directly into the fire zone.

The conduit attached to the fire vehicle, can be an insulated, telescoping, rigid metal conduit capable of holding cryogenic liquids or gases. It can also be a coiled accordion metal conduit for added flexibility, and extendibility. The fixed conduit on the vehicle can direct the fluid stream in all directions. The flexible conduit can be manually or mechanically directed.

This unique system has many advantages over existing fire fighting methods as follows:

Extinguishes all types of fires
Removes heat from the fuel and reduces oxygen
People and animals trapped in the fire can breath the mixture giving them more time to escape
High rise buildings are accessible
Since the system rapidly extinguishes fires, it reduces fire spread, pollution, and enhances the safety of the fire fighters
The cold gases protect the conduit system from fire heat.
Fire fighters would have coolant protection at the fire
The use of helicopters allows accessibility to high floors
Inert material used is low cost
Helicopters can be quickly sent to ships not in port

DRAWINGS

FIG. 1 illustrates a fire vehicle truck with integrated system in accordance with this invention.

FIG. 2 is a schematic flow diagram illustrating a system for introducing liquid inert material into a fire zone.

FIG. 3 illustrates another embodiment of my invention wherein the inert liquid is vaporized prior to introduction into the fire zone.

FIG. 4 is a schematic flow diagram illustrating yet another embodiment of my invention wherein the inert material is in the form of high-pressure gases.

FIG. 5 illustrates the extendable, insulated, telescoping metal tube in accordance with this invention.

FIG. 6 illustrates the flexible, coil accordion extendable metal conduit in accordance with this invention.

Figure 1:
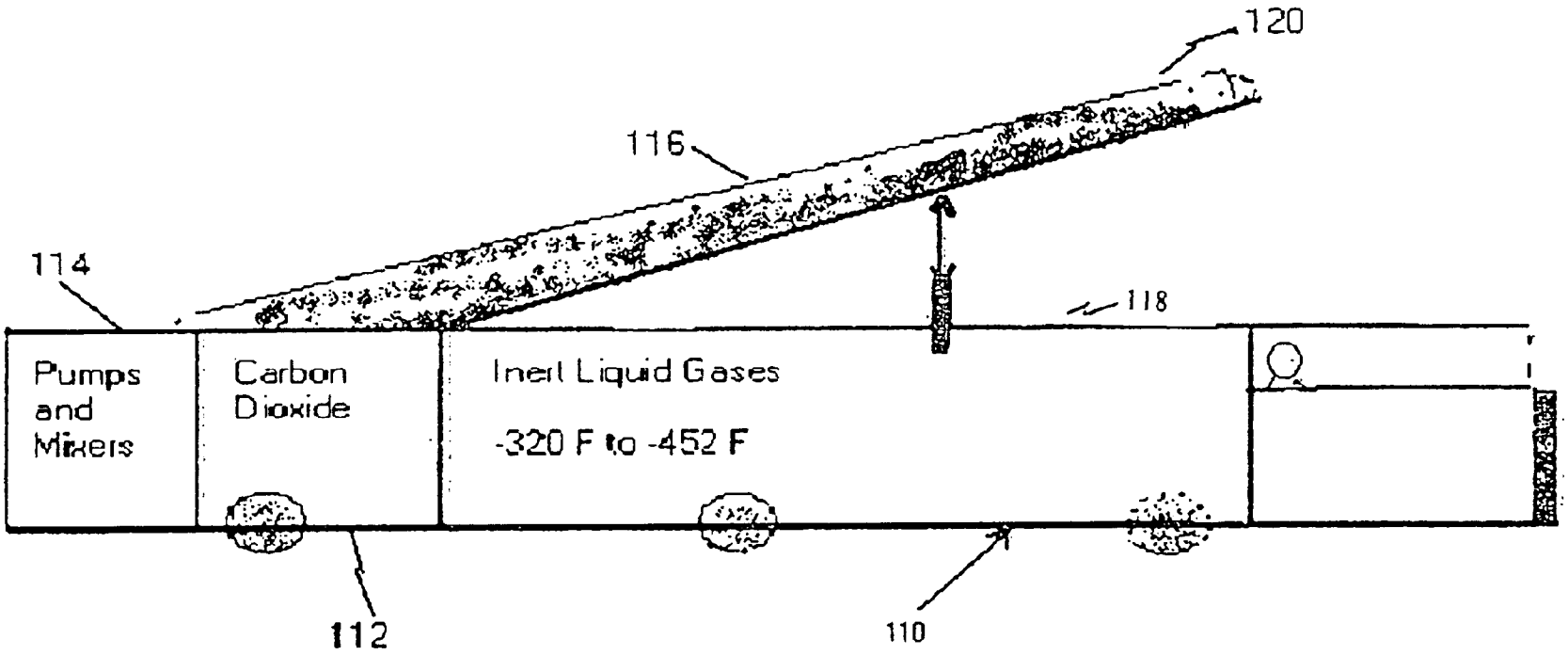
In FIG. 1 is shown a fire vehicle 110 with integrated system for transporting and delivering a fire extinguishing mixture to a fire zone. The vehicle can be a truck, boat or helicopter. An insulated vessels for holding cryogenic fluids 118, is mounted on the vehicle 110, as well as vessels for holding carbon dioxide in solid, liquid, gaseous or supercritical state 112. These vessels are connected via insulated conduits to pumps and mixers 114, and then to an extendable, insulated, rigid, adjustable metal conduit 116. At the end of the conduit is a metal lance 120 for penetrating windows and walls.
Figure 2:
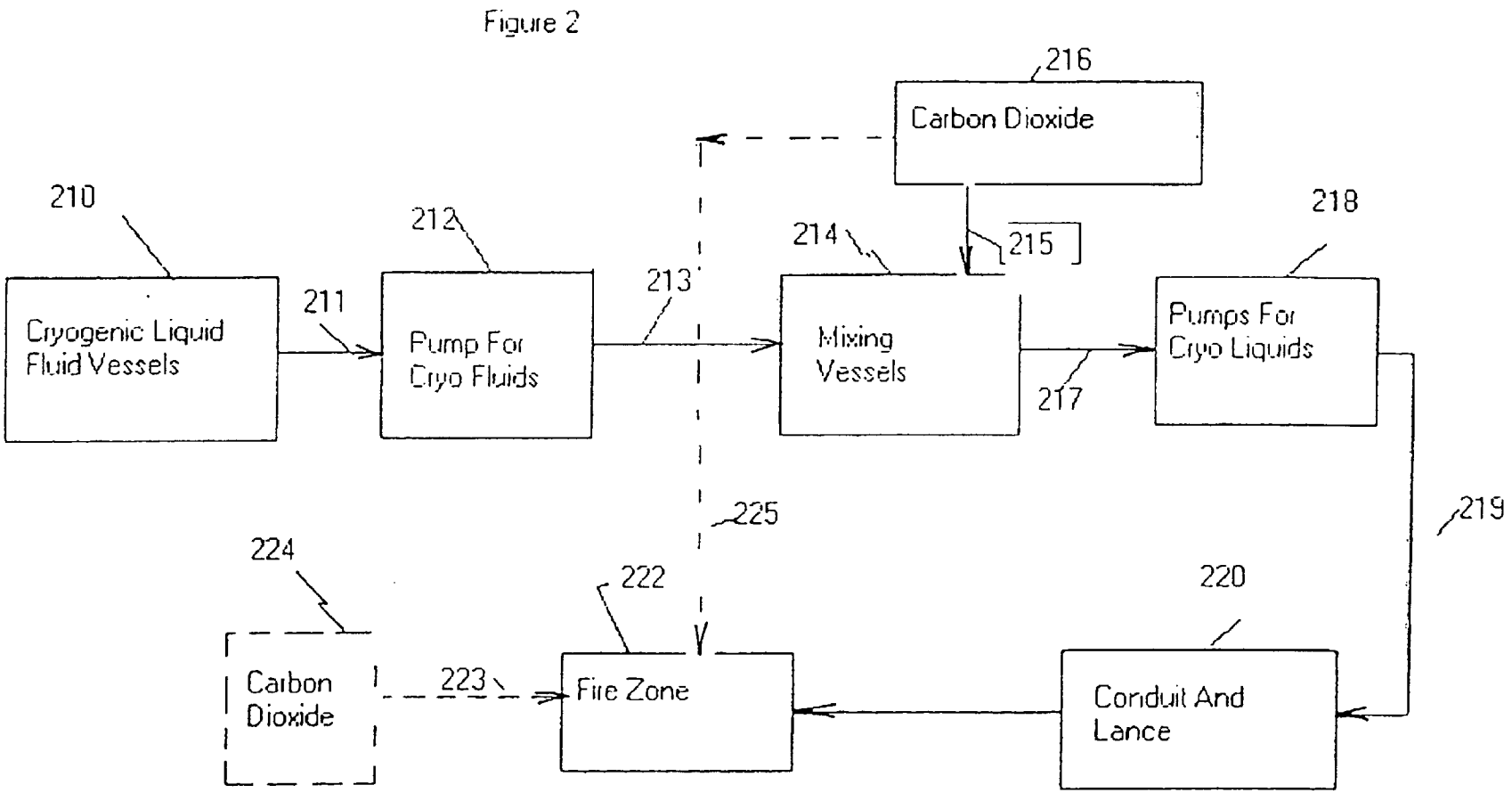
In FIG. 2 is a cryogenic liquid system showing the components of this integrated system. The insulated vessel 210 is connected to metering pump 212, used for moving cryogenic fluids, by means of line 211. The pump 212 is connected to mixing vessel 214 by means of line 213. Carbon dioxide holding vessel 216 is connected to mixing vessel 214 by means of metering line 215. The carbon dioxide can be in solid, liquid, gaseous or supercritical state. The mixing vessel 214 is connected to pump 218 by means of line 217, for moving the fluids. The pump 218 is connected to the conduit and lance system 220 by line 219, which deliver the fluids into the fire zone 222. Carbon dioxide from vessel 224 can also be introduced directly into the 222, as illustrated by line 223 or carbon dioxide from vessel 216 can be introduced directly into the fire zone 222 by means of line 225.
Figure 3:
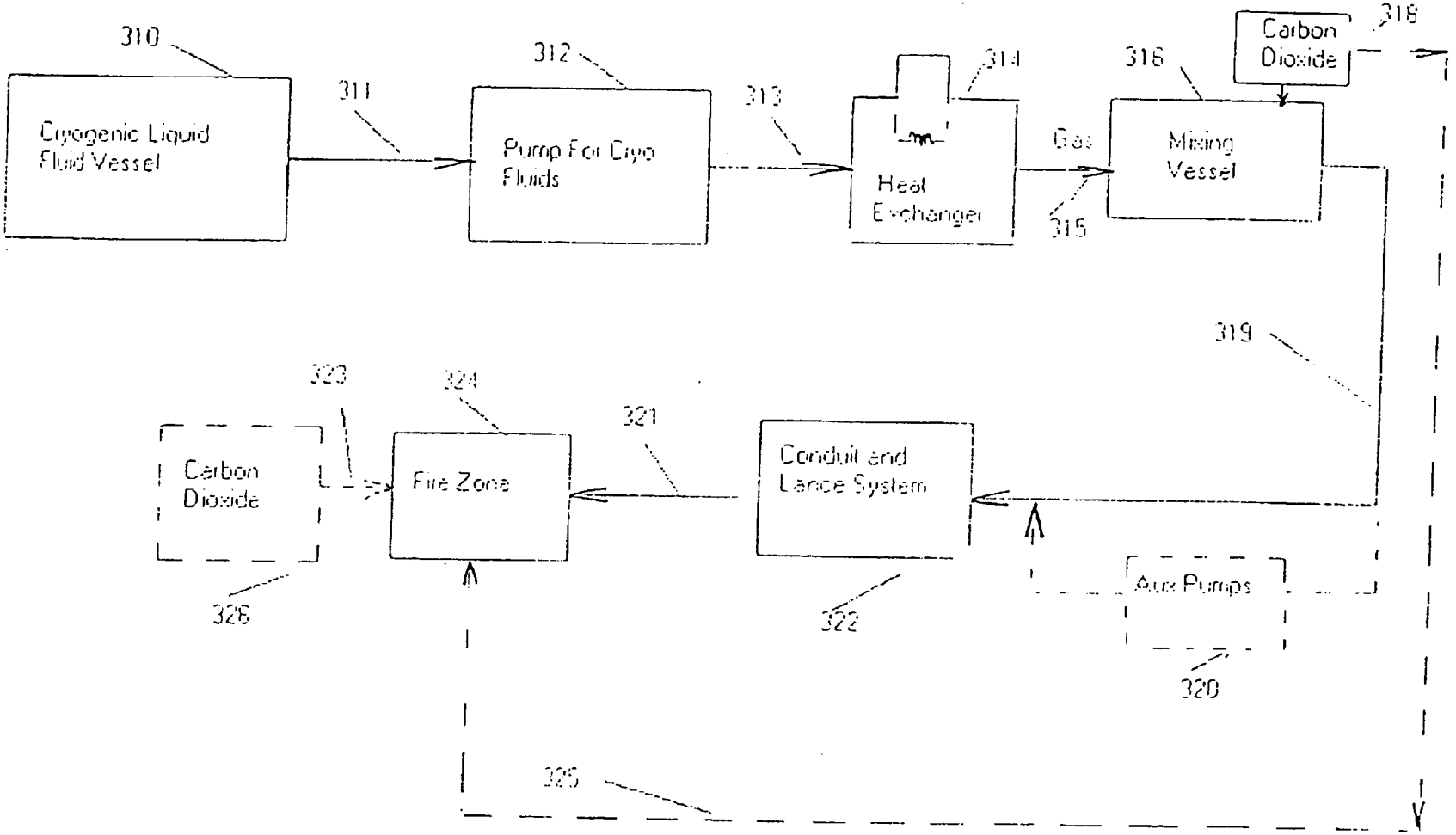
FIG. 3 is a cryogenic liquid to gas system. Vessel 310 and pump 312 are the same as vessel 210 and pump 212 in FIG. 2. Liquid inert material from vessel 310 is passed via line 311 to metering pump 312 and then pumped via line 313 to the heat exchanger 314, and converted into the gaseous state. The gas is transported via line 315 to the mixing vessel 316 along with metered carbon dioxide from 318. The mixture from mixing vessel 316 is transported to the conduit and lance system 322 as illustrated by line 319 and into the fire zone 324 as illustrated by line 321. Carbon dioxide from vessel 318 and br 326 can be either solid, liquid, gas or supercritical state. If needed an auxiliary pump 320 can be used to increase the pressure of the gas mix prior to introduction to the conduit and lance system 322. Carbon dioxide can also be fed directly into the fire zone 324 from separate carbon dioxide storage vessel 326, as shown by line 323. Carbon dioxide from vessel 318 can also be introduced separately into the fire zone 324 illustrated by line 325.
Figure 4:
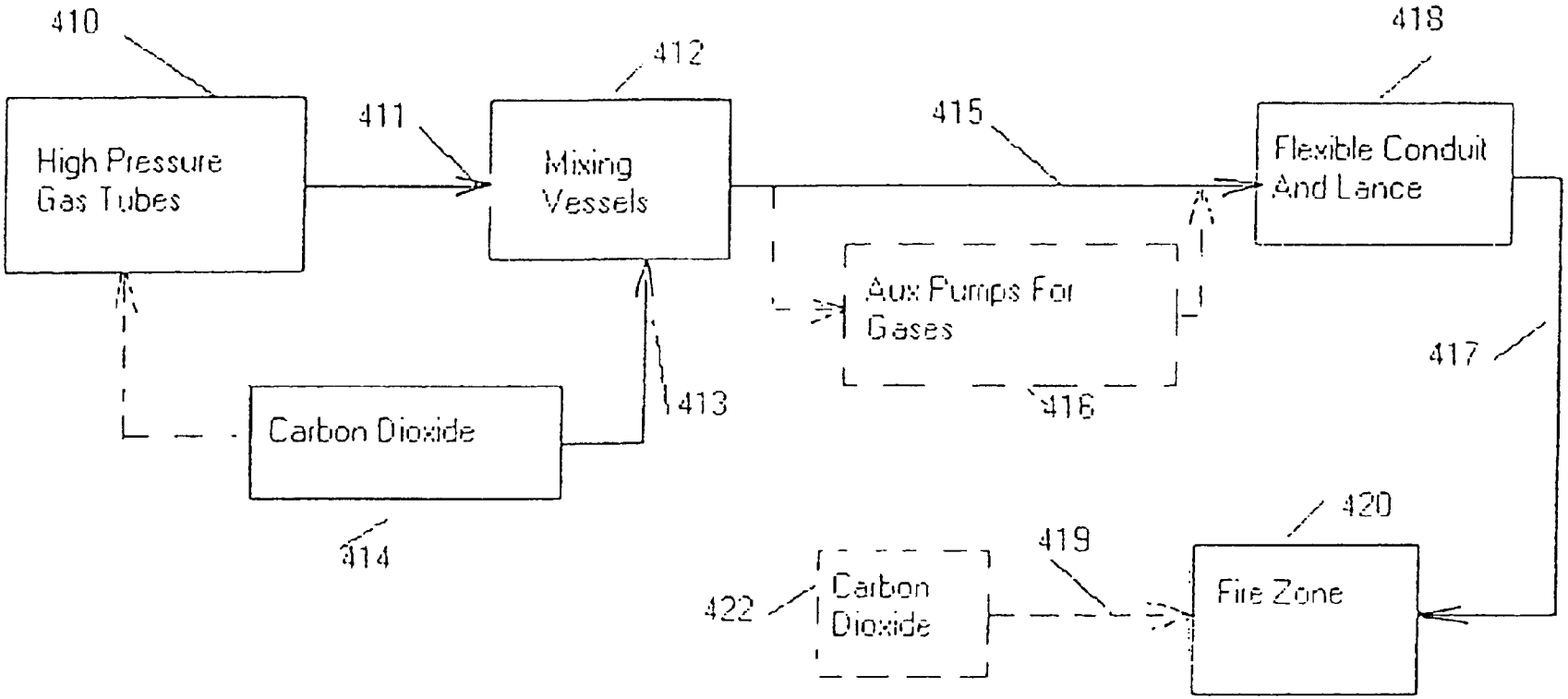
FIG. 4 is a high-pressure inert gas system for holding and delivering the fire extinguishing gas into the fire. High-pressure gas tubes 410 contain inert gases e.g. nitrogen, at pressures of 500 to 20,000 pounds per square inch. High-pressure gas tubes 410 can also contain carbon dioxide. The inert gas is transported and metered to the mixing vessels 412 via line 411, along with the metered carbon dioxide 414 via line 413. From the mixing vessels 412, the flow of gases through 420 is the same as in FIG. 3 from 316 through 324.

The mixture of gases is transported via line 415 to the flexible conduit and lance 418, and thence to the fire zone 420 as illustrated by line 417. Carbon dioxide the storage vessel 422 can be applied directly to the fire zone 420 as illustrated by line 419. If needed auxiliary pump 416 can be used to increase the pressure of the gas mixture delivered to the flexible conduit and lance 418.

Figure 5:
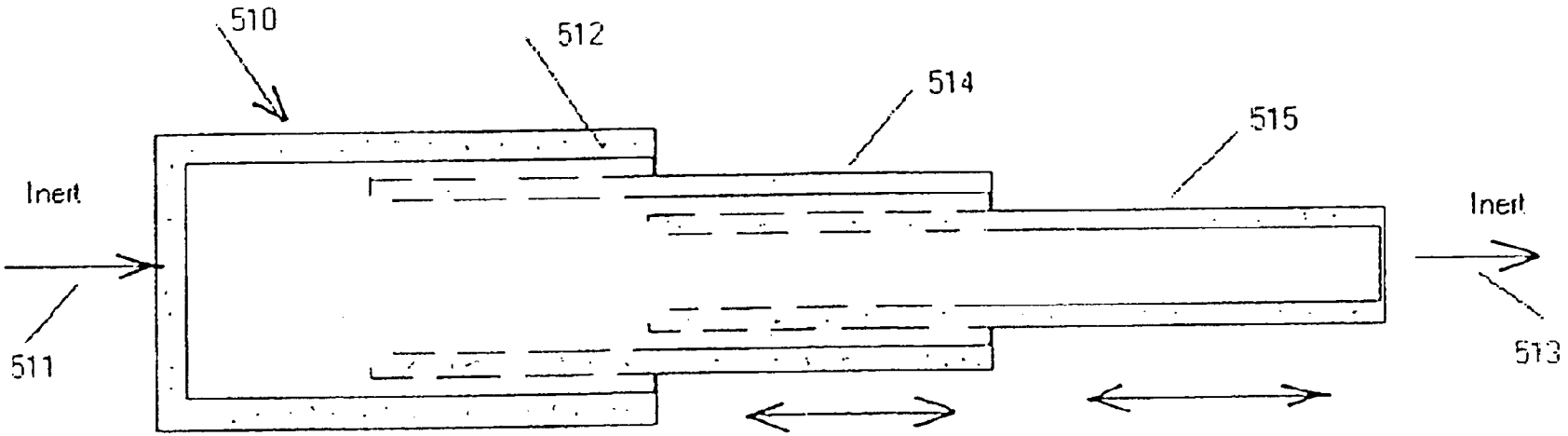

In FIG. 5 is shown a detailed illustration of the adjustable metal conduit 116 shown in FIG. 1. In this figure is shown an extendable metal tube 510 for delivering an incoming stream of inert material 511 and delivering it as 513 into the fire zone. The tubes are insulated with high value insulation and or a vacuum in the peripheral shell 512. The extendable portions illustrated as 514 and 515, are movable axially, so the inert stream 513 can be directed proximate and into the fire zone.

Figure 6:
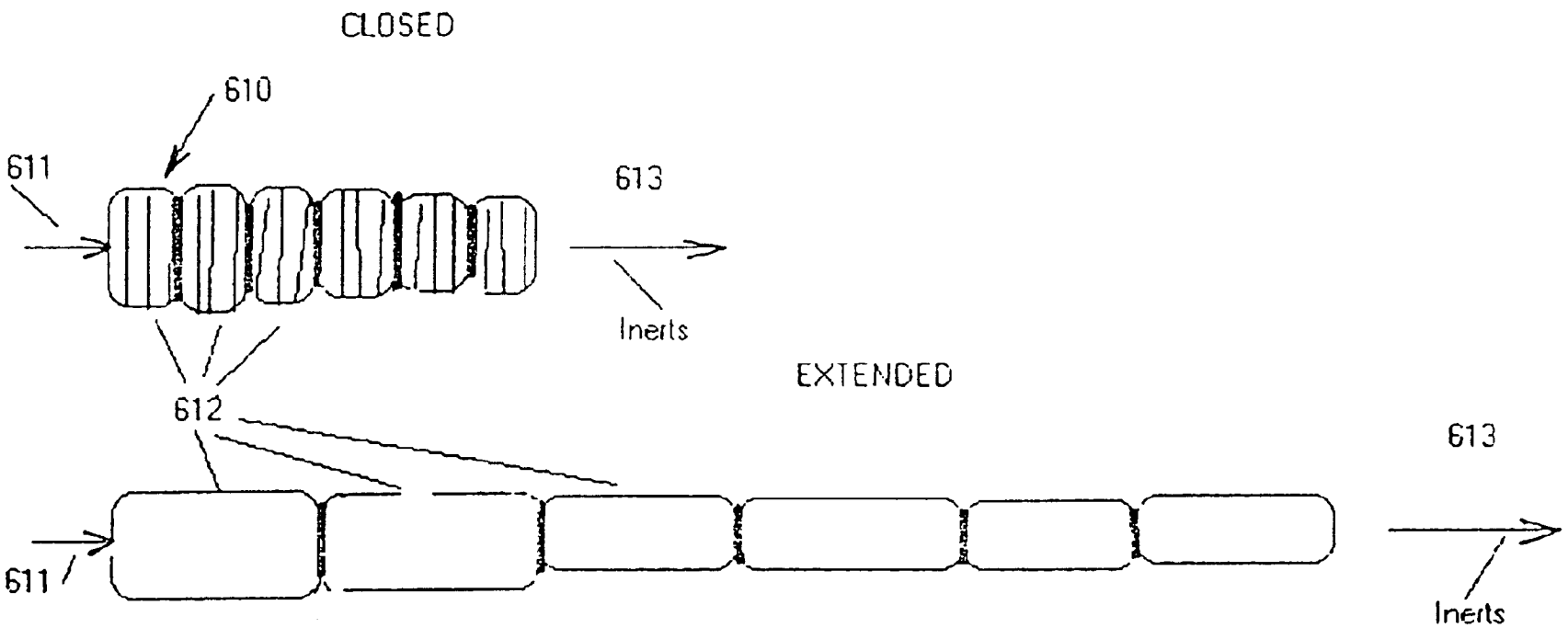

FIG. 6 shows a flexible, coiled, extendable, accordion conduit for delivering a mixture comprising a normally gaseous inert material, such as nitrogen, and carbon dioxide to a fire zone. The conduit has an inlet end 611 for admitting the mixture and an outlet end for delivering the mixture to the fire zone. The conduit, as illustrated, is composed of a series of interconnected coiled accordion members 612. At the top of FIG. 6 the members 612 are shown in a closed position, such as would be used when the system is being transported to a fire zone. At the bottom of FIG. 6 the members 612 are illustrated in an extended position, such as would be used when delivering the mixture to a fire zone. Thus, the conduit of this Figure is compact for transportation and can be extended to deliver the mixture to the fire zone at some distance remote from the vehicle upon which the system can be mounted.

What is claimed is:

1. A transportable system for delivering to an enclosed fire zone a breathable, fire extinguishing gas, which gas comprises a normally gaseous inert material and carbon dioxide, which system comprises a first storage vessel for the normally gaseous inert material, a second storage vessel for the carbon dioxide, and a delivery means for delivering the inert material and the carbon dioxide to the fire zone, the normally gaseous inert material and the carbon dioxide being delivered to the fire zone in the gaseous proportions of from about 88 to about 96% by volume normally gaseous inert material and from about 4 to about 12% by volume carbon dioxide.

2. The transportable system of claim 1, wherein the first storage vessel for the inert material is a cryogenic vessel which stores the inert material in liquid form.

3. The transportable system of claim 2, wherein the system also contains a means for vaporizing the inert material prior to introducing it into the fire zone.

4. The transportable system of claim 1 wherein the system also contains a means for mixing the inert material and carbon dioxide to form the breathable mixture.

5. The transportable system of claim of 4 which also contains a means for vaporizing the inert material located upstream of the means for mixing the inert material and carbon dioxide.

6. The transportable system of claim 1 wherein the storage vessel for the inert material is a pressure vessel for storing the inert material in gaseous form.

7. The transportable system of claim 4 wherein the vessel for storing carbon dioxide can store the carbon dioxide in a form selected from a group consisting of solid, liquid, gaseous and supercritical forms.

8. The transportable system of claim 4 wherein the means for mixing the inert material and carbon dioxide is located at the end of the delivery means which is in the area where the mixture is delivered to the fire zone.

9. The transportable system of claim 1 wherein the delivery means comprises a conduit, which is capable of transporting a cryogenic fluid.

10. The transportable system of claim 1 wherein the delivery means is a rigid, insulated, telescoping conduit.

11. The transportable system of claim 1 wherein the delivery means is a coiled metal flexible accordion conduit, which can be extended.

12. The transportable system of claim 4 wherein the carbon dioxide is introduced directly to the fire zone.

13. The system of claim 1 wherein the normally gaseous inert material is nitrogen.

14. The system of claim 13 wherein a mixture of the nitrogen and carbon dioxide is formed prior to introduction of the mixture into the tire zone.

15. The system of claim 14 wherein the nitrogen comprises at least about 90% by volume of the mixture.

16. The system of claim 14 wherein the carbon dioxide comprises at least about 6% by volume of the mixture.

17. The system of claim 14 wherein the nitrogen comprises less than about 94% by volume of the mixture.

18. The system of claim 14 wherein the carbon dioxide comprises less than about 10% by volume of the mixture.

19. The system of claim 14 wherein the mixture also contains air.

20. The system of claim 1 whereby the gaseous mixture provided in the fire zone contains from above about 8% to less than about 15% by volume oxygen and from about 2 to about 5% by volume of carbon dioxide.

* * * * *